US008368296B2

(12) United States Patent
Wei et al.

(10) Patent No.: US 8,368,296 B2
(45) Date of Patent: Feb. 5, 2013

(54) ELECTRON EMISSION APPARATUS AND METHOD FOR MAKING THE SAME

(75) Inventors: Yang Wei, Beijing (CN); Liang Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/081,336

(22) Filed: Apr. 6, 2011

(65) Prior Publication Data

US 2011/0181171 A1 Jul. 28, 2011

Related U.S. Application Data

(63) Continuation of application No. 12/313,934, filed on Nov. 26, 2008, now Pat. No. 7,967,655.

(30) Foreign Application Priority Data

Feb. 1, 2008 (CN) ..... 2008 1 0066050

(51) Int. Cl.
*H01J 1/304* (2006.01)

(52) U.S. Cl. ..... 313/495; 313/497

(58) Field of Classification Search ..... 313/495–497
See application file for complete search history.

(56) References Cited

U.S. PATENT DOCUMENTS

| | | | | |
|---|---|---|---|---|
| 6,891,320 | B2 | 5/2005 | Nakamoto | |
| 2002/0060514 | A1* | 5/2002 | Nakamoto | 313/311 |
| 2003/0122467 | A1* | 7/2003 | Cho et al. | 313/309 |
| 2004/0095050 | A1* | 5/2004 | Liu et al. | 313/309 |
| 2004/0183421 | A1* | 9/2004 | Nakamoto | 313/309 |
| 2007/0145878 | A1 | 6/2007 | Liu et al. | |
| 2008/0170982 | A1* | 7/2008 | Zhang et al. | 423/447.3 |

FOREIGN PATENT DOCUMENTS

| | | | |
|---|---|---|---|
| JP | P2002-157951 | A | 5/2002 |
| JP | P2003-016905 | A | 1/2003 |
| JP | P2003-288837 | A | 10/2003 |
| JP | 2004-303521 | | 10/2004 |
| JP | 2005-32523 | | 2/2005 |
| JP | 2005-135846 | | 5/2005 |
| JP | 2005-162571 | | 6/2005 |
| JP | P2006-108120 | A | 4/2006 |
| JP | P2007-080626 | A | 3/2007 |
| JP | P2007-173238 | A | 7/2007 |
| JP | 2009-152202 | | 7/2009 |
| JP | 2009-187945 | | 8/2009 |

* cited by examiner

*Primary Examiner* — Nimeshkumar Patel
*Assistant Examiner* — Christopher Raabe
(74) *Attorney, Agent, or Firm* — Altis Law Group, Inc.

(57) ABSTRACT

An electron emission apparatus includes an insulating substrate, one or more grids located on the substrate, wherein the one or more grids includes: a first, second, third and fourth electrode that are located on the periphery of the grid, wherein the first and the second electrode are parallel to each other, and the third and fourth electrodes are parallel to each other; and one or more electron emission units located on the substrate. Each the electron unit includes at least one electron emitter, the electron emitter includes a first end, a second end and a gap; wherein the first end is electrically connected to one of the plurality of the first electrodes and the second end is electrically connected to one of the plurality of the third electrodes; two electron emission ends are located in the gap, and each electron emission end includes a plurality of electron emission tips.

15 Claims, 10 Drawing Sheets

ELECTRON EMISSION APPARATUS AND METHOD FOR MAKING THE SAME

CROSS-REFERENCE TO RELATED APPLICATIONS

This application claims all benefits accruing under 35 U.S.C. §119 from China Patent Application No. 200810066050.4, filed on Feb. 1, 2008 in the China Intellectual Property Office. This application is related to commonly-assigned applications entitled, "ELECTRON EMISSION APPARATUS AND METHOD FOR MAKING THE SAME", Ser. No. 12/313,938, filed on Nov. 26, 2008; "METHOD FOR MAKING FIELD EMISSION ELECTRON SOURCE", Ser. No. 12/313,937, filed on Nov. 26, 2008; "CARBON NANOTUBE NEEDLE AND THE METHOD FOR MAKING THE SAME", Ser. No. 12/313,935, filed on Nov. 26, 2008; and "FIELD EMISSION ELECTRON SOURCE", Ser. No. 12/313,932, filed on Nov. 26, 2008. This application is a division of U.S. patent application Ser. No. 12/313,934, filed on Nov. 26, 2008, entitled, "ELECTRON EMISSION APPARATUS AND METHOD FOR MAKING THE SAME".

BACKGROUND

1. Technical Field

The present invention relates to electron emission apparatuses and methods for making the same and, particularly, to a carbon nanotube based electron emission apparatus and a method for making the same.

2. Description of Related Art

Conventional electron emission apparatuses include field emission displays (FED) and surface-conduction electron-emitter displays (SED). The electron emission apparatus can emit electrons in the principle of a quantum tunnel effect opposite to a thermal excitation effect, which is of great interest from the viewpoints of promoting high brightness and low power consumption.

Referring to FIG. 8, a field emission device 300 includes an insulating substrate 302, a number of electron emission units 310, cathode electrodes 308, and gate electrodes 304. The electron emission units 310, cathode electrodes 308, and gate electrodes 304 are located on the insulating substrate 302. The cathode electrodes 308 and the gate electrodes 304 cross each other to form a plurality of crossover regions. A plurality of insulating layers 306 are arranged corresponding to the crossover regions. Each electron emission unit 310 includes at least one electron emitter 312. The electron emitter 312 is in electrical contact with the cathode electrode 308 and spaced from the gate electrode 304. When receiving a voltage that exceeds a threshold value, the electron emitter 312 emits electron beams towards an anode. The luminance is adjusted by altering the applied voltage. However, the distance between the gate electrode 304 and the cathode electrode 308 is uncontrollable. As a result, the driving voltage is relatively high, thereby increasing the overall operational cost.

Referring to FIG. 9 and FIG. 10, a surface-conduction electron-emitter device 400 includes an insulating substrate 402, a number of electron emission units 408, cathode electrodes 406, and gate electrodes 404 located on the insulating substrate 402. Each gate electrode 404 includes a plurality of interval-setting prolongations 4042. The cathode electrodes 406 and the gate electrodes 404 cross each other to form a plurality of crossover regions. The cathode electrodes 406 and the gate electrodes 404 are insulated by a number of insulating layers 412. Each electron emission unit 408 includes at least one electron emitter 410. The electron emitter 410 is in electrical contact with the cathode electrode 406 and the prolongation 4042. The electron emitter 410 includes an electron emission portion. The electron emission portion is a film including a plurality of small particles. When a voltage is applied between the cathode electrode 406 and the prolongation 4042, the electron emission portion emits electron beams towards an anode. However, because the space between the particles in the electron emission portion is small and the anode voltage can't be applied into the inner portion of the electron emission, the efficiency of the surface-conduction electron-emitter device 400 is relatively low.

What is needed, therefore, is to provide a highly efficient electron emission apparatus with a simple structure and a method for making the same.

BRIEF DESCRIPTION OF THE DRAWINGS

Many aspects of the present electron emission apparatus and method for making the same can be better understood with references to the following drawings. The components in the drawings are not necessarily drawn to scale, the emphasis instead being placed upon clearly illustrating the principles of the present electron emission apparatus and method for making the same.

Figure 1:
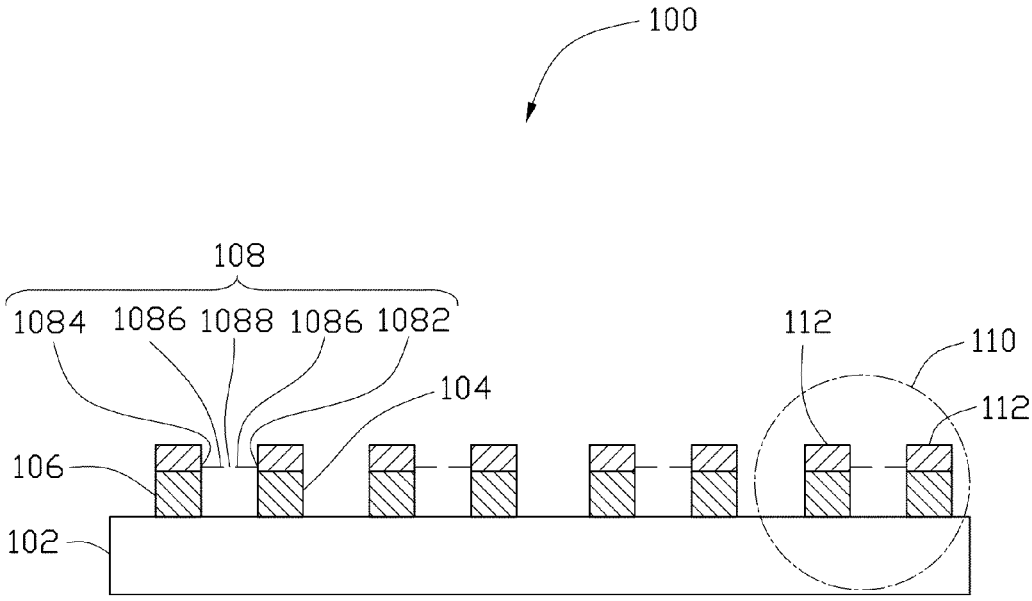
FIG. 1 is a schematic side view of an electron emission apparatus, in accordance with an exemplary embodiment.

Corresponding reference characters indicate corresponding parts throughout the several views. The exemplifications set out herein illustrate at least one embodiment of the present electron emission apparatus and method for making the same, in at least one form, and such exemplifications are not to be construed as limiting the scope of the invention in any manner.

DETAILED DESCRIPTION

References will now be made to the drawings to describe, in detail, embodiments of the present electron emission device and method for making the same.

Figure 2:
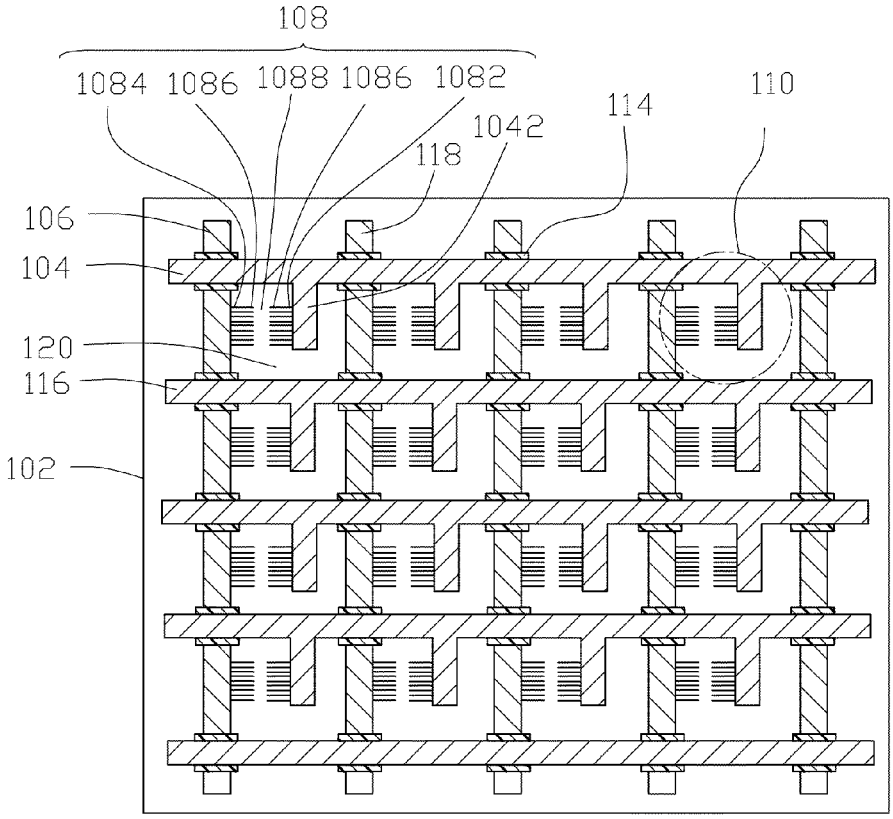
FIG. 2 is a schematic top view of the electron emission apparatus of FIG. 1.

Referring to FIG. 1 and FIG. 2, an electron emission apparatus 100 includes an insulating substrate 102, one or more electron emission units 110 and grids 120, a plurality of first electrodes 104, second electrodes 116, third electrodes 106 and fourth electrodes 118. The electron emission units 110, grids 120, first electrodes 104, second electrodes 116, third electrodes 106 and fourth electrodes 118 are located on the insulating substrate 102. Each electron emission unit 110 is located in one grid 120. The first electrode 104, second electrode 116, third electrode 106 and fourth electrode 118 are located on the periphery of the grid 120. The first electrodes 104 and the second electrode 116 are parallel to each other, and the third electrode 106 and the fourth electrode 118 are parallel to each other. Furthermore, a plurality of insulating layers 114 are sandwiched between the electrodes 104, 106, 116, 118 at the intersection thereof, to avoid a short circuit.

The insulating substrate 102 can be made of glass, ceramics, resin, or quartz. In this embodiment, the insulating substrate 102 is made of glass. A thickness of the insulating substrate 102 is determined according to user-specific needs.

The first electrodes 104, second electrodes 116, third electrodes 106 and fourth electrodes 118 are made of conductive material. A space between the first electrode 104 and the second electrode 116 approximately ranges from 100 to 1000 microns. A space between the third electrode 106 and the fourth electrode 118 approximately ranges from 100 to 1000 microns. The first electrodes 104, second electrodes 116, third electrode 106 and fourth electrode 118 have a width approximately ranging from 30 to 200 microns and a thickness approximately ranging from 10 to 50 microns. Each first electrode 104 includes a plurality of prolongations 1042 parallel to each other. The prolongations 1042 are connected to the first electrode 104. A space between the adjacent prolongations 1042 approximately ranges from 100 to 1000 microns. A shape of the prolongations 1042 is determined according to user-specific needs. In this embodiment, the first electrodes 104, second electrodes 116, third electrode 106 and fourth electrode 118 are strip-shaped planar conductors formed by a method of screen-printing. The prolongations 1042 are structured like an isometric cubic. The length of the prolongations 1042 is approximately 100 to 900 microns, the width of the prolongations 1042 is approximately 30 to 200 microns and a thickness of the prolongations 1042 is approximately 10 to 50 microns.

The first electrode 104, second electrode 116, third electrode 106 and fourth electrode 118 form a grid 120. While in one grid the second electrode 116 is in fact the second electrode 116, in an adjacent grid that same electrode will act as a first electrode 104 for the adjacent grid. The same is true for all of the electrodes that help define more than one grid.

Each electron emission unit 110 includes at least one electron emitter 108. The electron emitter 108 includes a first end 1082, a second end 1084 and a gap 1088. The first end 1082 is electrically connected to one of the plurality of the first electrodes 104 or the second electrodes 116, and the second end 1084 is electrically connected to one of the plurality of the third electrodes 106 or the fourth electrodes 118. The first end 1082 is opposite to the second end 1084. Two electron emission ends 1086 are located beside the gap 1088, and each electron emission end 1086 includes a plurality of electron emission tips. The width of the gap 1088 approximately ranges from 1 to 20 microns. The electron emission end 1086 and the electron emission tip are cone-shaped, and the diameter of the electron emission end 1086 is smaller than the diameter of the electron emitter 108. When receiving a voltage between the first electrodes 104 (or second electrodes 116) and the third electrodes 106 (or fourth electrodes 118), the electron emission end 1086 of the electron emitters 108 can easily emit electron beams, thereby improving the electron emission efficiency of the electron emission apparatus 100. The electron emitter 108 comprises a conductive linear structure and can be selected from a group consisting of metal wires, carbon fiber wires and carbon nanotube wires.

The electron emitters 108 in each electron emission unit 110 are uniformly spaced. Each electron emitter 108 is arranged substantially perpendicular to the third electrode 106 or the fourth electrode 118 of each grid 120.

In the present embodiment, the electron emitter 108 comprises a carbon nanotube wire. A diameter of the carbon nanotube wire approximately ranges from 0.1 to 20 microns, and a length of the carbon nanotube wire approximately ranges from 50 to 1000 microns. Each carbon nanotube wire includes a plurality of continuously oriented and substantially parallel-arranged carbon nanotube segments joined end-to-end by van der Waals attractive force. Furthermore, each carbon nanotube segment includes a plurality of substantially parallel-arranged carbon nanotubes, wherein the carbon nanotubes have an approximately the same length and are substantially parallel to each other.

Moreover, each carbon nanotube wire can also include a plurality of continuously twisted carbon nanotube segments joined end-to-end by van der Waals attractive force. Furthermore, each twisted carbon nanotube segment includes a plurality of carbon nanotubes.

The carbon nanotubes of the carbon nanotube wire can be selected from a group comprising of single-wall carbon nanotubes, double-wall carbon nanotubes, multi-wall carbon nanotubes, and any combination thereof. A diameter of the carbon nanotubes approximately ranges from 0.5 to 50 nanometers.

Figure 3:
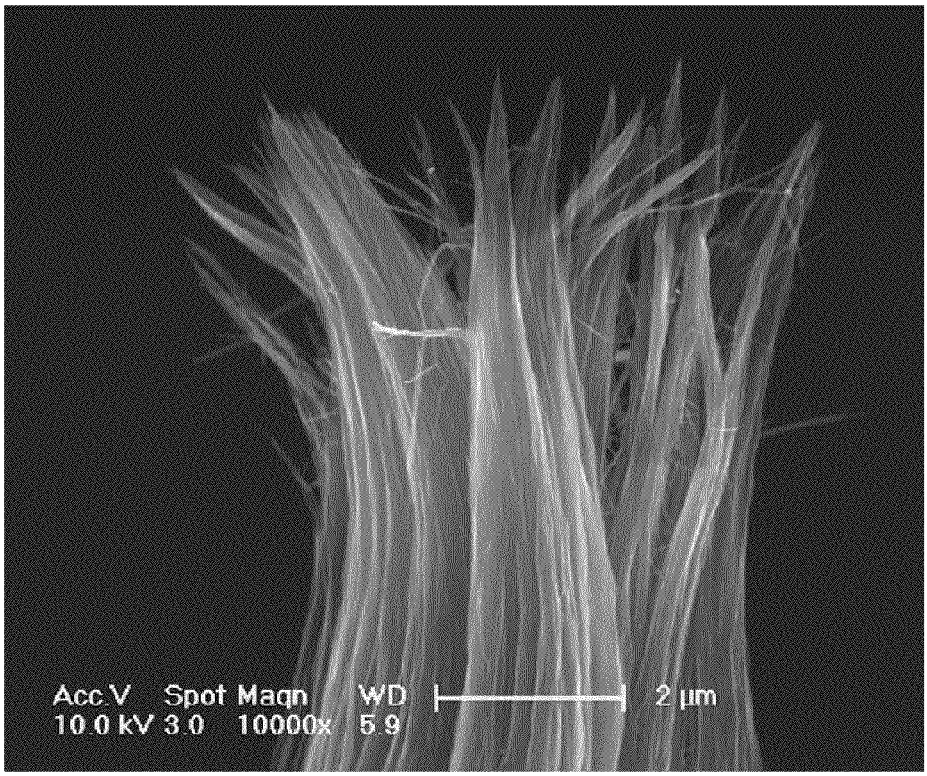
FIG. 3 shows a Scanning Electron Microscope (SEM) image of an electron emission tip of a carbon nanotube wire used in the electron emission apparatus of FIG. 1.
Figure 4:
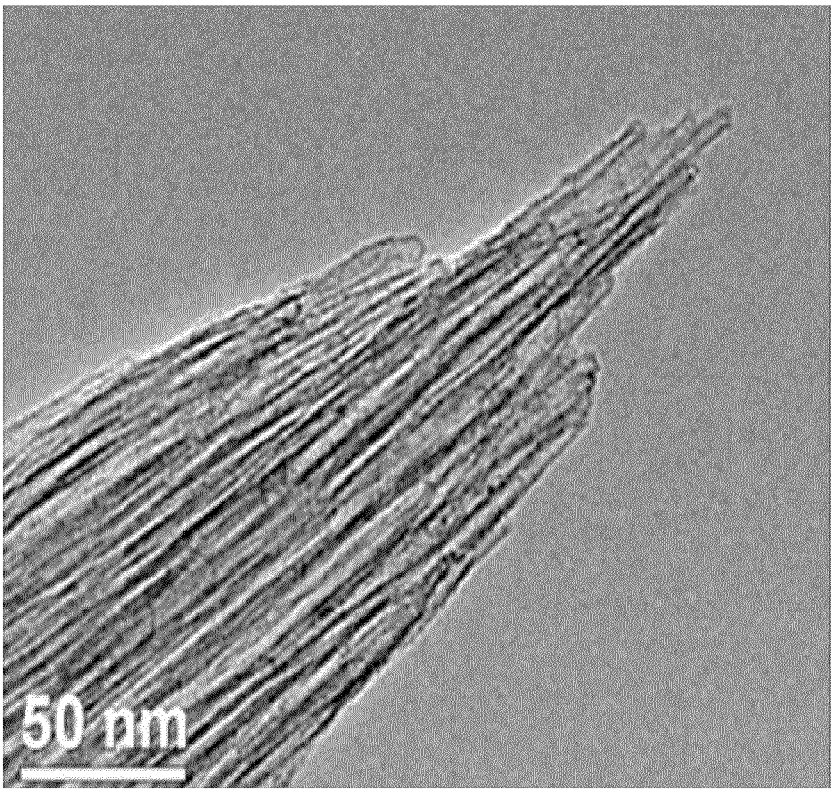
FIG. 4 shows a Transmission Electron Microscope (TEM) image of the electron emission tip of FIG. 3.

Referring to FIG. 3 and FIG. 4, the electron emission end of the carbon nanotube wire includes a plurality of electron emission tips. Each electron emission tip includes a plurality of arranged carbon nanotubes. The carbon nanotubes are combined with each other by van der Waals attractive force. One carbon nanotube extends from the parallel carbon nanotubes in each electron emission tip.

The electron emission apparatus 100 further includes a plurality of fixed elements 112 located on the top of the electrodes 104, 106, 116, 118. The fixed elements 112 are used for fixing the electron emitters 108 on the top of the electrodes 104, 106, 116, 118. The material of the fixed element 112 is determined according to user-specific needs. When the prolongations 1042 are formed, the fixed elements 112 are formed on the top of the prolongations 1042.

Figure 5:
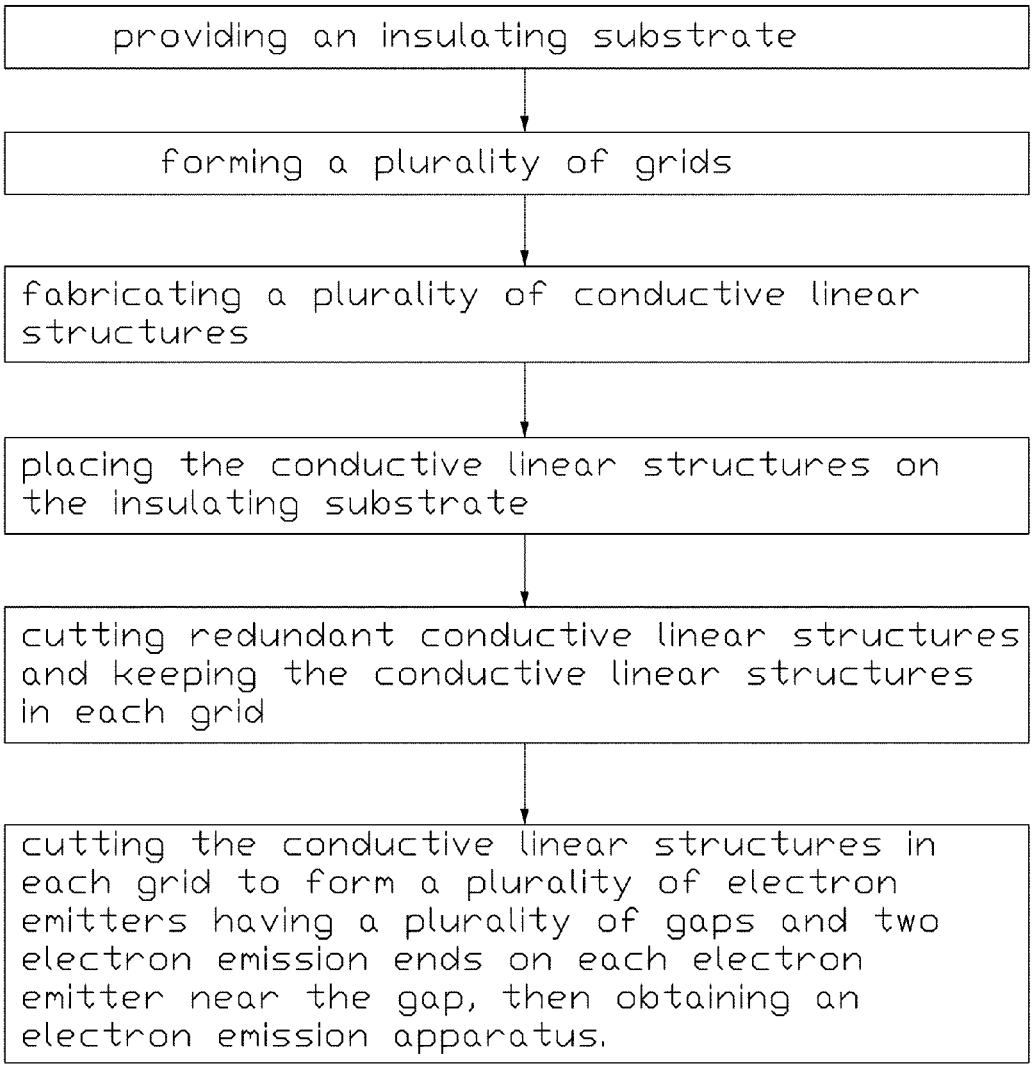
FIG. 5 is a flow chart of a method for making an electron emission apparatus, in accordance with an exemplary embodiment.

Referring to FIG. 5 and FIG. 2, a method for making the electron emission apparatus 100 includes the following steps: (a) providing an insulating substrate 102 (e.g., a glass substrate); (b) forming a plurality of grids 120; (c) fabricating a plurality of conductive linear structures; (d) placing the conductive linear structures on the insulating substrate 102; (e) cutting redundant conductive linear structures and keeping the conductive linear structures in each grid 120; the cutting can be done with a laser; and (f) cutting the conductive linear structures in each grid 120 to form a plurality of electron emitters 108 having a plurality of gaps 1088 and two electron emission ends 1086 on each electron emitter 108 near the gap 1088, then obtaining an electron emission apparatus 100.

In step (b), the grids 120 can be formed by the following substeps: (b1) forming a plurality of uniformly-spaced first electrodes 104 and second electrodes 116 parallel to each other on the insulating substrate 102 by a method of screen-printing; (b2) forming a plurality of insulating layers 114 at the crossover regions between the first electrodes 104, the second electrodes 116, the third electrodes 106, and the fourth electrodes 118 by the method of screen-printing; (b3) forming a plurality of uniformly-spaced third electrodes 106 and fourth electrodes 118 parallel to each other on the insulating substrate 102 by the method of screen-printing. The first electrodes 104 and the second electrodes 116 are insulated from the third electrodes 106 and the fourth electrodes 118 through the insulating layer 114 at the crossover regions thereof. The first electrodes 104 and the second electrodes 116, the third electrodes 106 and the fourth electrodes 118 can be respectively and electrically connected together by a connection external of the grid 120.

In step (b1), a conductive paste is printed on the insulating substrate 102 by the method of screen-printing to form the first electrodes 104 and the second electrodes 116. The conductive paste includes metal powder, low-melting frit, and organic binder. A mass ratio of the metal powder in the conductive paste approximately ranges from 50% to 90%. A mass ratio of the low-melting glass powder in the conductive paste approximately ranges from 2% to 10%. A mass ratio of the binder in the conductive paste approximately ranges from 10% to 40%. In this embodiment, the metal powder is silver powder and binder is terpilenol or ethylcellulose.

In step (c), the conductive linear structures can be metal wires, carbon nanofiber wires, or carbon nanotube wires. The conductive linear structures are parallel to each other. The carbon nanotube wire can be fabricated by the following substeps: (c1) providing an array of carbon nanotubes and a super-aligned array of carbon nanotubes; (c2) pulling out a carbon nanotube structure from the array of carbon nanotubes via a pulling tool (e.g., adhesive tape, pliers, tweezers, or another tool allowing multiple carbon nanotubes to be gripped and pulled simultaneously), the carbon nanotube structure is a carbon nanotube film or a carbon nanotube yarn; (c3) treating the carbon nanotube structure with an organic solvent or external mechanical force to form a carbon nanotube wire.

In step (c1), a given super-aligned array of carbon nanotubes can be formed by the following substeps: (c11) providing a substantially flat and smooth substrate; (c12) forming a catalyst layer on the substrate; (c13) annealing the substrate with the catalyst at a temperature approximately ranging from 700° C. to 900° C. in air for about 30 to 90 minutes; (c14) heating the substrate with the catalyst at a temperature approximately ranging from 500° C. to 740° C. in a furnace with a protective gas therein; and (c15) supplying a carbon source gas into the furnace for about 5 to 30 minutes and growing a super-aligned array of the carbon nanotubes from the substrate.

In step (c11), the substrate can be a P-type silicon wafer, an N-type silicon wafer, or a silicon wafer with a film of silicon dioxide thereon. A 4-inch P-type silicon wafer is used as the substrate in this embodiment.

In step (c12), the catalyst can, advantageously, be made of iron (Fe), cobalt (Co), nickel (Ni), or any alloy thereof.

In step (c14), the protective gas can be made up of at least one of the following gases: nitrogen ($N_2$), ammonia ($NH_3$), and a noble gas. In step (b15), the carbon source gas can be a hydrocarbon gas, such as ethylene ($C_2H_4$), methane ($CH_4$), acetylene ($C_2H_2$), ethane ($C_2H_6$), or any combination thereof.

The super-aligned array of carbon nanotubes can be approximately 200 to 400 microns in height and includes a plurality of carbon nanotubes parallel to each other and substantially perpendicular to the substrate. The super-aligned array of carbon nanotubes formed under the above conditions is essentially free of impurities, such as carbonaceous or residual catalyst particles. The carbon nanotubes in the super-aligned array are packed together closely by van der Waals attractive force.

In step (c2), the carbon nanotube structure can be pulled out from the super-aligned array of carbon nanotubes by the following substeps of: (c21) selecting a number of carbon nanotube segments having a predetermined width from the array of carbon nanotubes; and (c22) pulling the carbon nanotube segments at an even/uniform speed to form the carbon nanotube structure.

In step (c21) the carbon nanotube segments having a predetermined width can be selected by using a wide adhesive tape as the tool to contact the super-aligned array. Each carbon nanotube segment includes a plurality of carbon nanotubes parallel to each other, and combined by van der Waals attractive force therebetween. The carbon nanotube segments can vary in width, thickness, uniformity and shape. In step (c22), the pulling direction can be arbitrary (e.g., substantially perpendicular to the growing direction of the super-aligned array of carbon nanotubes).

More specifically, during the pulling process, as the initial carbon nanotube segments are drawn out, other carbon nanotube segments are also drawn out end-to-end, due to the van der Waals attractive force between ends of adjacent carbon nanotube segments. This process of drawing ensures a continuous, uniform carbon nanotube structure can be formed. The carbon nanotubes of the carbon nanotube structure are all substantially parallel to the pulling direction, and the carbon nanotube structure produced in such manner have a selectable, predetermined width.

The width of the carbon nanotube structure (i.e., carbon nanotube film or yarn) depends on the size of the carbon nanotube array. The length of the carbon nanotube structure is determined according to a practical application. In this embodiment, when the size of the substrate is 4 inches, the width of the carbon nanotube structure is in the approximately ranges from 1 to 10 centimeters, and the thickness of the carbon nanotube structure approximately ranges from 0.01 to 100 microns.

In step (c3), the carbon nanotube structure is soaked in an organic solvent. Since the untreated carbon nanotube structure is composed of a number of carbon nanotubes, the untreated carbon nanotube structure has a high surface area to volume ratio and thus may easily become stuck to other objects. During the surface treatment, the carbon nanotube structure is shrunk into a carbon nanotube wire after the organic solvent volatilizing process, due to factors such as surface tension. The surface-area-to-volume ratio and diameter of the treated carbon nanotube wire is reduced. Accordingly, the stickiness of the carbon nanotube structure is lowered or eliminated, and strength and toughness of the carbon nanotube structure is improved. The organic solvent may be a volatilizable organic solvent at room temperature, such as ethanol, methanol, acetone, dichloroethane, chloroform, and any combination thereof.

In step (c3), the carbon nanotube structure can also be treated with an external mechanical force (e.g., a conventional spinning process) to acquire a twisted carbon nanotube wire. A process of treating the carbon nanotube structure includes the following substeps: (c31) providing a spinning axis; (c32) attaching one end of the carbon nanotube structure to the spinning axis; and (c33) spinning the spinning axis to form the twisted carbon nanotube wire.

In step (d), at least one conductive linear structure is placed between the first electrode 104 (or the second electrode 116) and the third electrode 106 (or the fourth electrode 118) in each grid 120. When the prolongations 1042 are formed, the conductive linear structure can be placed between the first electrode 104 (or the second electrode 116) and the prolongation 1042, and connected to the third electrode 106 (or the fourth electrode 118) by the prolongation 1042. Before the conductive linear structures are arranged, the electrodes are coated with conductive adhesive so that the conductive linear structures can be firmly fixed on the electrodes. A plurality of fixed electrodes 112 can also be printed on the electrodes by the method of screen-printing.

In step (f), via the cutting step, the conductive linear structures are broken to form two electron emission ends 1086, and as such, a gap 1088 is formed therebetween. The cutting step can be performed by methods of laser ablation, electron beam scanning, or vacuum fuse. In the present embodiment, the method of cutting the conductive linear structures is by vacuum fuse include the following steps: (f1) applying a voltage between the electrodes, in a vacuum or an inert gases environment; and (f2) heating the conductive linear structures on the insulating substrate in each grid. In a vacuum or inert gases circumstance, receiving a voltage between the first electrodes 104 and the third electrode 106. Thus, the conductive linear structures on the insulating substrate 102 along a direction from the first electrodes 104 (or the second electrodes 116) to the third electrode 106 (or the fourth electrodes 118) are heated to separate. In the separated position, two electron emission ends 1086 are formed. In this embodiment, the conductive linear structures comprise carbon nanotube wires. A temperature of heating the carbon nanotube wires approximately ranges from 2000 to 2800 K. A time of heating the carbon nanotube wires approximately ranges from 20 to 60 minutes.

Figure 6:
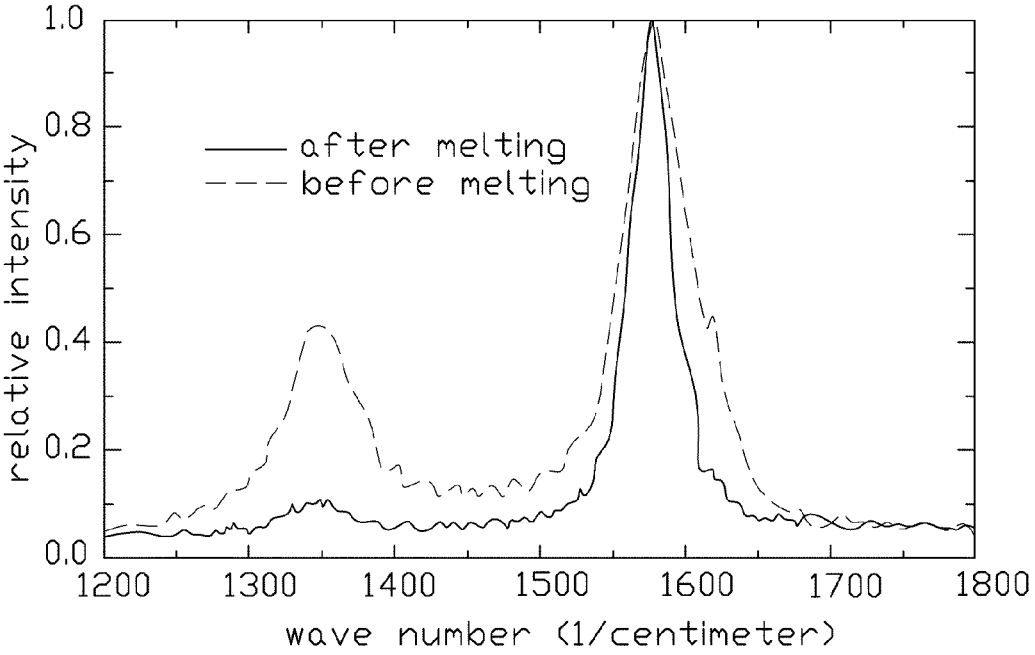
FIG. 6 shows a Raman spectroscopy of the electron emission tip of FIG. 3.

Referring to FIG. 6, after the carbon nanotube wires are heated, defects of the electron emission tips thereof are decreased, thereby improving the quality of the carbon nanotubes in the electron emission tips.

Figure 7:
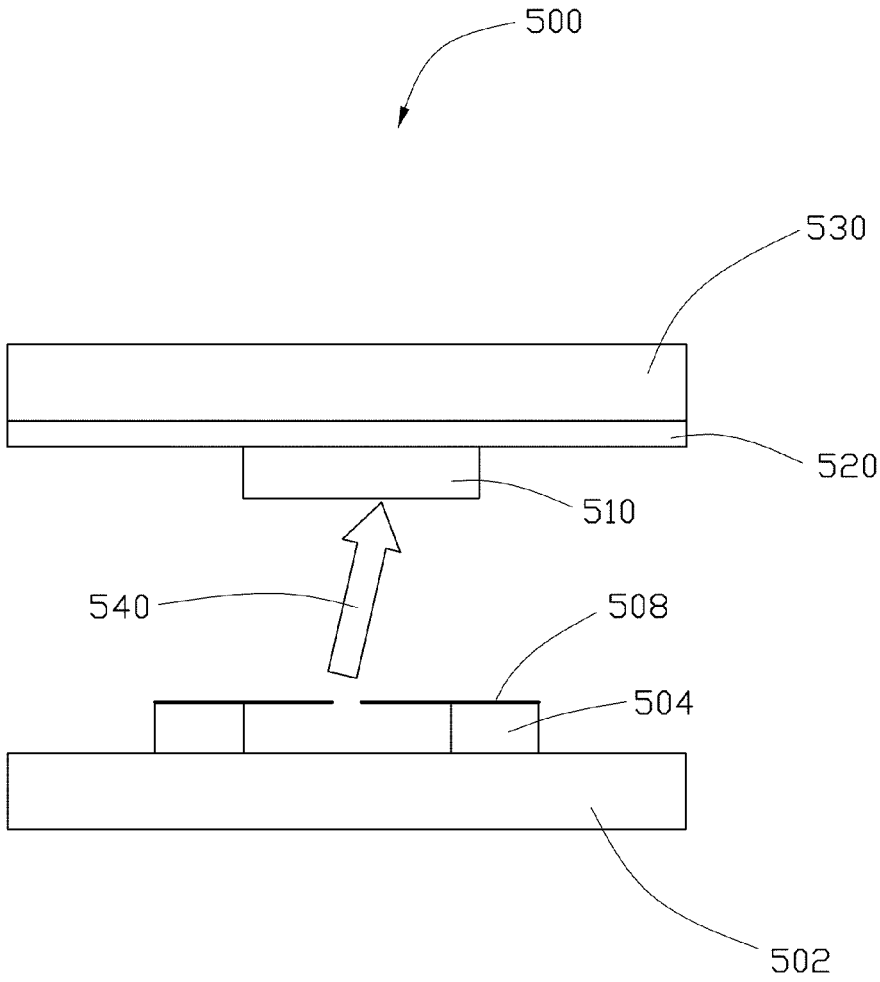
FIG. 7 is a schematic side view of a field emission display.
Figure 8:
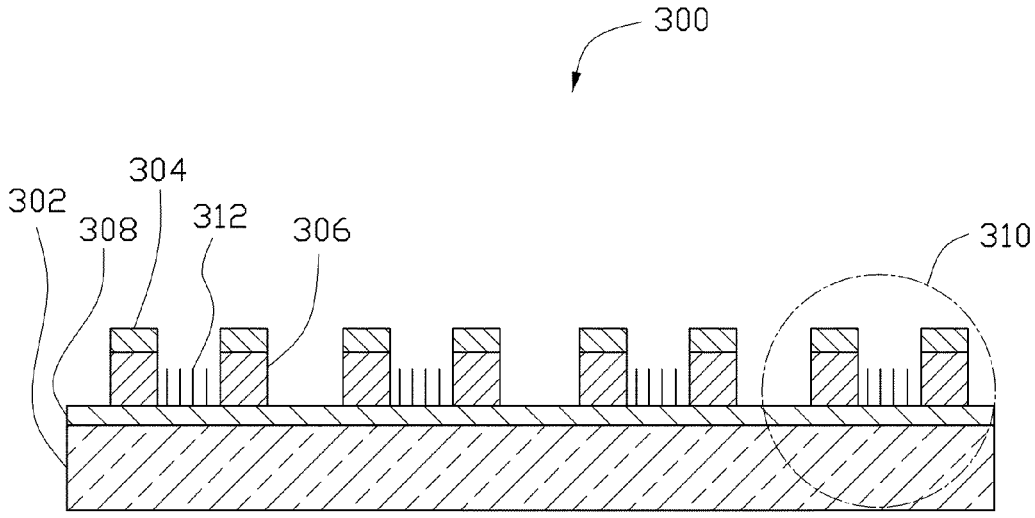
FIG. 8 (PRIOR ART)
FIG. 8 is a schematic side view of a conventional field emission device according to the prior art.
Figure 9:
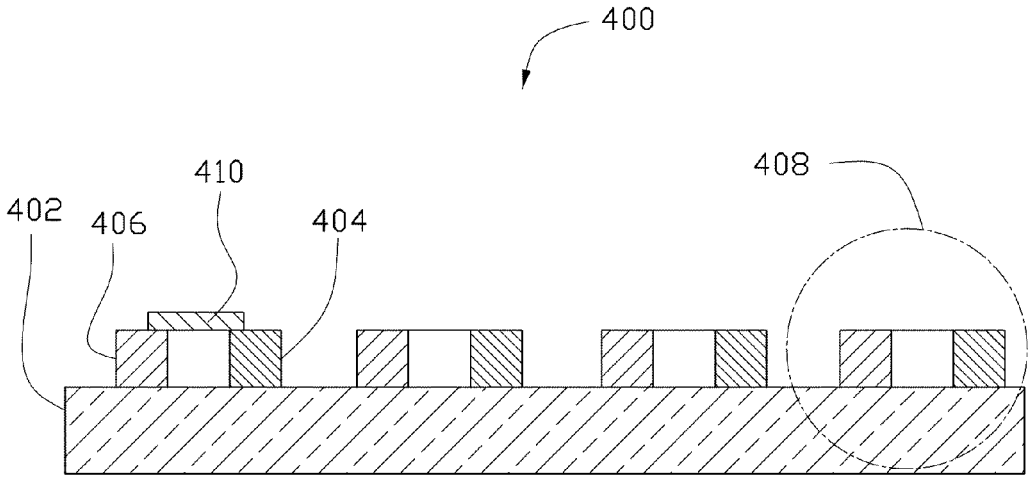
FIG. 9 (PRIOR ART)
FIG. 9 is a schematic side view of a conventional surface-conduction electron-emitter device according to the prior art.
Figure 10:
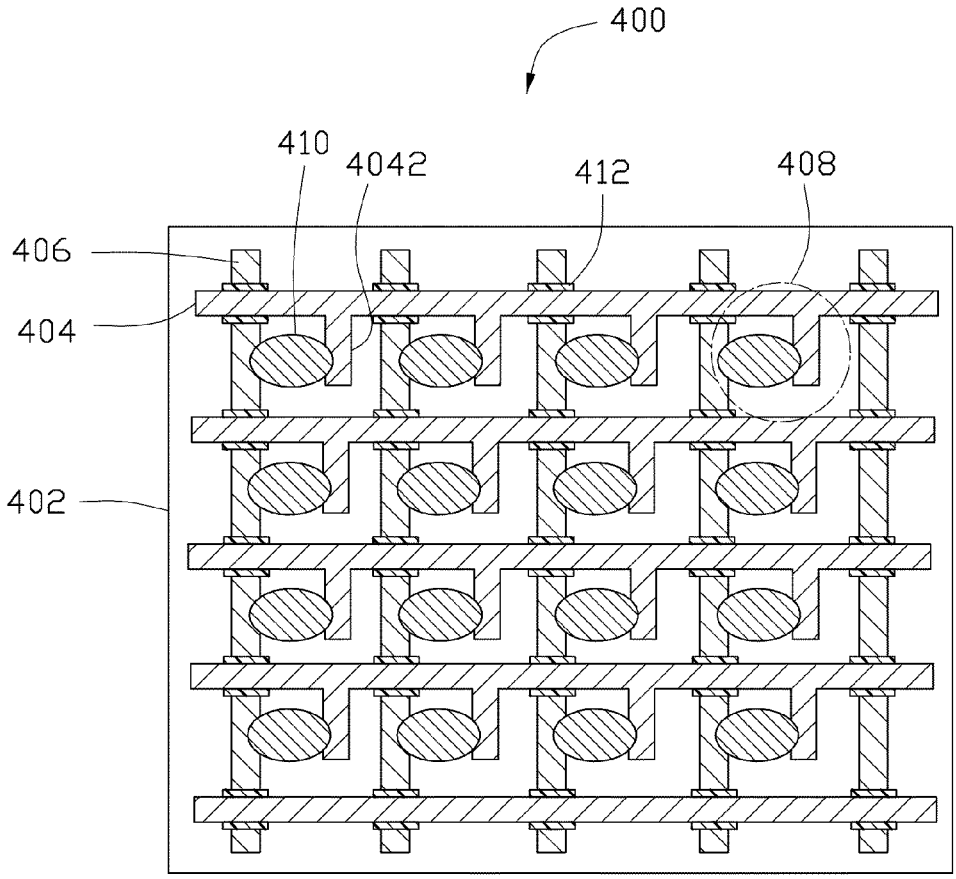
FIG. 10 (PRIOR ART)
FIG. 10 is a schematic top view of the conventional surface-conduction electron-emitter device of FIG. 9.

Referring to FIG. 7, the electron emission apparatus can be used in an electron emission display 500. The electron emission display 500 includes an anode substrate 530 facing the cathode substrate 502, an anode layer 520 formed on the lower surface of the anode substrate 530, an phosphor layer 510 formed on the anode layer 520, an electron emission apparatus facing the anode substrate 530. The electron emission apparatus includes a plurality of electrodes 504 and electron emitters 508 formed on the top of the electrodes 504 and supported thereby. When using, voltage differences is applied between the electrodes 504 and the anode layer 520, thus, electrons 540 are emitted from the electron emitters 508 and moving toward to the anode layer 520.

Compared to the conventional electron emission apparatus, the present electron emission apparatus 100 has the following advantages: (1) the structure of the electron emission apparatus 100 is simple, wherein the first electrodes 104, second electrodes 116, third electrodes 106, fourth electrodes 118 and the electron emitters 108 are coplanar; (2) each electron emitter 108 includes a gap 1088, the electron emission end 1086 of the electron emitter 108 can easily emit the electrons by applying a voltage between the first electrode 104 and the third electrode 106, thereby improving the electron emission efficiency of the electron emission apparatus 100.

It is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

It is also to be understood that the description and the claims may include some indication in reference to certain steps. However, the indication used is applied for identification purposes only, and the identification should not be viewed as a suggestion as to the order of the steps.

What is claimed is:

1. An electron emission apparatus comprising:

an insulating substrate; and at least one grid located on the insulating substrate, the at least one grid comprising:

a first electrode, a second electrode, a third electrode, and a fourth electrode located on a periphery of the at least one grid, wherein the first and second electrodes are parallel to each other, and the third and fourth electrodes are parallel to each other; and an electron emission unit, the electron emission unit comprising at least one linear shaped electron emitter, the at least one linear shaped electron emitter comprising:

a first end electrically connected with the first electrode, and a second end electrically connected with the third electrode; and two electron emission ends defining a gap located between the first end and the second end, wherein the at least one linear shaped electron emitter is a carbon nanotube wire, the carbon nanotube wire comprises a plurality of carbon nanotube segments joined along a longitudinal axis of the carbon nanotube wire by van der Waals attractive force, each of the plurality of carbon nanotube segments comprises a plurality of carbon nanotubes substantially parallel with each other and combined with each other by van der Waals attractive force therebetween, each of the two electron emission ends comprises a plurality of cone shaped electron emission tips, each of the plurality of cone shaped electron emission tips comprises at least one of the plurality of carbon nanotube segments.

2. The electron emission apparatus as claimed in claim 1, wherein a space of the gap ranges from about 1 micron to about 20 microns.

3. The electron emission apparatus as claimed in claim 1, wherein the at least one grid further comprises a prolongation, and the prolongation is connected to the first electrode.

4. The electron emission apparatus as claimed in claim 3, wherein the prolongation is spaced from the second electrode.

5. The electron emission apparatus as claimed in claim 1, wherein the at least one linear shaped electron emitter comprises a plurality of electron emitters that are substantially parallel to each other.

6. The electron emission apparatus as claimed in claim 1, wherein the at least one linear shaped electron emitter is arranged substantially perpendicular to the third electrode and the fourth electrode.

7. The electron emission apparatus as claimed in claim 1, wherein the plurality of carbon nanotube segments are continuously oriented along a same direction.

8. The electron emission apparatus as claimed in claim 1, wherein a diameter of the carbon nanotube wire ranges from about 0.1 microns to about 20 microns.

9. The electron emission apparatus as claimed in claim 1, wherein one carbon nanotube of the plurality of carbon nanotubes extends from the plurality of carbon nanotubes in each of the cone shaped electron emission tips.

10. The electron emission apparatus as claimed in claim 1, further comprising a plurality of fixed elements located on the first electrode, the third electrode or both the first electrode and the third electrode; and the fixed elements fix the at least one linear shaped electron emitter on the first electrode, the third electrode or both the first electrode and the third electrode.

11. An electron emission apparatus comprising:

an insulating substrate;

a plurality of first electrodes and a plurality of second electrodes located on the insulating substrate, wherein the plurality of first electrodes and the plurality of second electrodes are spaced from and parallel to each other;

a plurality of third electrodes and a plurality of fourth electrodes located on the insulating substrate, wherein the plurality of third electrodes and the plurality of fourth electrodes are spaced from and parallel to each other, wherein the plurality of first electrodes and the plurality of second electrodes are insulated from and intersect the plurality of third electrodes and the plurality of fourth electrodes, thus defining a plurality of grids; each of the plurality of grids comprises an electron emission unit comprising at least one carbon nanotube wire, the at least one carbon nanotube wire comprises:

a first end electrically connected with one of the plurality of first electrodes or one of the plurality of second electrodes;

a second end electrically connected with one of the plurality of third electrodes or one of the plurality of fourth electrodes, and two electron emission ends defining a gap, each electron emission end comprises a plurality of electron emission tips, the plurality of electron emission tips are cone-shaped, each of the plurality of electron emission tips comprises a plurality of parallel carbon nanotubes combined with each other by van der Waals attractive force comprising a single carbon nanotube extending through the plurality of parallel carbon nanotubes, the single carbon nanotube forms a tip of each of the cone-shaped electron emission tips.

12. An electron emission apparatus comprising:

an insulating substrate having a surface;

a plurality of first electrodes and a plurality of second electrodes located on the insulating substrate, wherein the plurality of first electrodes and the plurality of second electrodes are spaced and parallel to each other;

a plurality of third electrodes and a plurality of fourth electrodes located on the insulating substrate, wherein the plurality of third electrodes and the plurality of fourth electrodes are spaced and parallel to each other;

wherein the plurality of first electrodes and the plurality of second electrodes are insulated from and intersect the plurality of third electrodes and the plurality of fourth electrodes, thus defining a plurality of grids; each of the plurality of grids comprises an electron emission unit comprising a plurality of carbon nanotube wires, the plurality of carbon nanotube wires are spaced from each other, each of the plurality of carbon nanotube wires comprises a plurality of carbon nanotube segments joined end-to-end by van der Waals attractive force, each of the plurality of carbon nanotube segments comprises a plurality of carbon nanotubes substantially parallel with each other and combined with each other by van der Waals attractive force therebetween, each of the plurality of carbon nanotube wires has:

a first end electrically connected with one of the plurality of first electrodes or one of the plurality of second electrodes, a second end electrically connected with one of the plurality of third electrodes or one of the plurality of fourth electrodes, and two electron emission ends defining a gap, a portion of the plurality of carbon nanotube segments defines a plurality of cone-shaped electron emission tips at each of the two electron emission ends, each of the plurality of electron emission tips comprises a plurality of carbon nanotubes combined with each other by van der Waals attractive force.

13. The electron emission apparatus as claimed in claim 12, wherein one carbon nanotube extends from the plurality of carbon nanotubes in each of the plurality of electron emission tips.

14. The electron emission apparatus as claimed in claim 13, wherein the plurality of carbon nanotube segments are joined along a longitudinal axis of the carbon nanotube wire by van der Waals attractive force.

15. The electron emission apparatus as claimed in claim 12, wherein the plurality of carbon nanotube wires are substantially parallel to the surface.

* * * * *